US005421260A

United States Patent [19]

Döbler

[11] Patent Number: 5,421,260

[45] Date of Patent: Jun. 6, 1995

[54] APPARATUS FOR ADJUSTING THE IMPRESSION OF AN IMPRESSION CYLINDER EQUIPPED WITH A TUBE WHICH CAN BE SLIPPED ON

[75] Inventor: Hermann Döbler, Plauen, Germany

[73] Assignee: MAN Roland Druckmashinen AG, Offenbach, Germany

[21] Appl. No.: 163,092

[22] Filed: Dec. 7, 1993

[30] Foreign Application Priority Data

Dec. 10, 1992 [DE] Germany ..... 42 41 567.5

[51] Int. Cl.[6] ..... B41F 13/24

[52] U.S. Cl. ..... 101/247; 101/185; 101/209; 101/192; 101/145

[58] Field of Search ..... 101/145, 185, 192, 247, 101/284, 285, 139, 140, 182, 184, 143, 144, 191, 209

[56] References Cited

U.S. PATENT DOCUMENTS

| | | | |
|---|---|---|---|
| 4,622,895 | 11/1986 | Dorow et al. | 101/216 X |
| 5,237,920 | 8/1993 | Guaraldi | 101/216 |
| 5,311,817 | 5/1994 | Funada | 101/247 X |

FOREIGN PATENT DOCUMENTS

| | | | |
|---|---|---|---|
| 0513756A1 | 11/1992 | European Pat. Off. . | |
| 357509 | 8/1922 | Germany . | |
| 1112995 | 8/1961 | Germany | 101/247 |
| 1227916 | 11/1966 | Germany . | |
| 2139503 | 3/1972 | Germany . | |
| 3702889 | 8/1988 | Germany . | |
| 0172739 | 8/1986 | Japan | 101/216 |
| 2206081 | 12/1988 | United Kingdom | 101/247 |

OTHER PUBLICATIONS

Copy of European Search Report (4 pages).
Copy of German Search Report P 42 41 567.5.

*Primary Examiner*—Chris A. Bennett
*Attorney, Agent, or Firm*—Cohen, Pontani, Lieberman, Pavane

[57] ABSTRACT

An apparatus for adjusting the impression of an impression cylinder, equipped with a tube that can be slipped on, in a rotary press, the mounting of which apparatus has an eccentric bush equipped with a gearing, which is engaged in the operating state by an eccentric adjustment, which can be shifted out of the region of an opening enabling an exchange of tubes and is equipped with a gearing. A toothed quadrant, engaging the gearing of the eccentric bush, and a working cylinder, which is operated by a pressure medium and linked to the toothed quadrant, are pivotably connected with a rocking lever, which is mounted in the supporting frame and engaged by a two-membered driven toggle joint, which is pivotably connected at the other end with the supporting frame.

9 Claims, 1 Drawing Sheet

APPARATUS FOR ADJUSTING THE IMPRESSION OF AN IMPRESSION CYLINDER EQUIPPED WITH A TUBE WHICH CAN BE SLIPPED ON

BACKGROUND OF THE INVENTION

1. Field of Invention

The invention relates to an apparatus for turning on and off the pressure of a cylinder, such as an impression cylinder, equipped with a slipped-on tube or sleeve in a rotary printing mechanism. The mounting of the apparatus has an eccentric bush equipped with a gearing which is engaged in an operating state by an eccentric adjustment. The mounting can be shifted out of the region of an opening so as to enable an exchange of tubes and is equipped with a gearing.

2. Description of the Prior Art

An apparatus is known (German Offenlegungsschrift 37 02 889), in which the supporting frames are equipped with jaws for exchanging the tube of the impression cylinder. The jaws can be moved apart sideways and serve as a mounting for the impression cylinder. In each case, one of the jaws has an electric motor with a gear wheel for making eccentric adjustments. In the operating state, the gear wheel engages an eccentric bush equipped with gearing for adjusting the impression cylinder.

The jaws, which can be moved apart, require relatively large space, which can be realized only with difficulty, particularly in the case of a multicylinder arrangement. Moreover, the guides for the jaws are difficult to manufacture with regard to accuracy requirements that have to be met.

SUMMARY OF THE INVENTION

It is an object of the present invention to provide an apparatus for turning on and off the pressure of a cylinder, such as an impression cylinder, of the above-mentioned type which is equipped with a tube or sleeve that can be slipped on. This inventive apparatus makes it possible with simple means, requiring little space, to exchange tubes in the rotary press and to adjust the impression cylinder in the operating state so that it functions reliably.

Pursuant to this object, and others which will become apparent hereafter, one aspect of the present invention resides in an apparatus of the above-discussed type which has a toothed quadrant that engages the gearing of the eccentric bush, and a working cylinder that is operated by a pressure medium and linked to the toothed quadrant. The toothed quadrant and the working cylinder are pivotably connected with a rocking lever that is mounted in the supporting frame. The rocking lever is engaged by a two-membered driving toggle joint that is pivotably connected at its other end with the supporting frame.

The apparatus, consisting of simple component parts, can be disposed at any freely available space in the area in which the impression cylinder is mounted and requires little space for its adjustment from the operating position into the position for the exchange of tubes. With regard to the robustness and simplicity of the materials used, the apparatus guarantees a reliably functioning adjustment of the impression cylinder even after long periods of time between the adjustments.

In another embodiment of the invention, the movement of the rocking lever in the direction of the gearing of the eccentric bush is limited by an adjustable stop. The stop is formed by a body fastened to the supporting frame and having a tapped hole penetrated by an adjusting screw. This enables the toothed quadrant to be adjusted in the operating state relative to the gearing of the eccentric bush.

By linking the working cylinder in the pivot of the rocking lever, the cylinder is suspended independent of a restoring moment on the rocking lever.

In a further embodiment for driving the toggle joint an additional working cylinder, which is operated by a pressure medium and mounted in the supporting frame, pivotably engages the toggle joint. The point of attack of the working cylinder being variable with respect to the design of the apparatus and the available space.

In an additional embodiment of the invention, a second toothed quadrant is fastened at the eccentric bush and engages the toothed quadrant of the rocking lever.

In still another embodiment a locking body is connected with the rocking lever. The locking body can be brought into positive engagement with a bearing bush rotatably disposed on the eccentric bush. The locking body can be constructed as a toothed quadrant that engages another toothed quadrant fastened to the bearing bush. The toothed quadrant is adjustably mounted on a bearing bolt for the toothed quadrant which adjusts the eccentric bush. The locking body toothed quadrant has a slot that extends in the adjusting direction and is penetrated by a clamping screw that is carried in a tapped hole of the rocking lever. This ensures in a simple manner, on the one hand, the fixing of the bearing bush serving to support the axle journal of the impression cylinder against twisting of the eccentric bush, which brings about the impression adjustment of the impression cylinder, and, on the other hand, the releasing of the opening in the supporting frame from the arresting body for the exchange of tubes.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
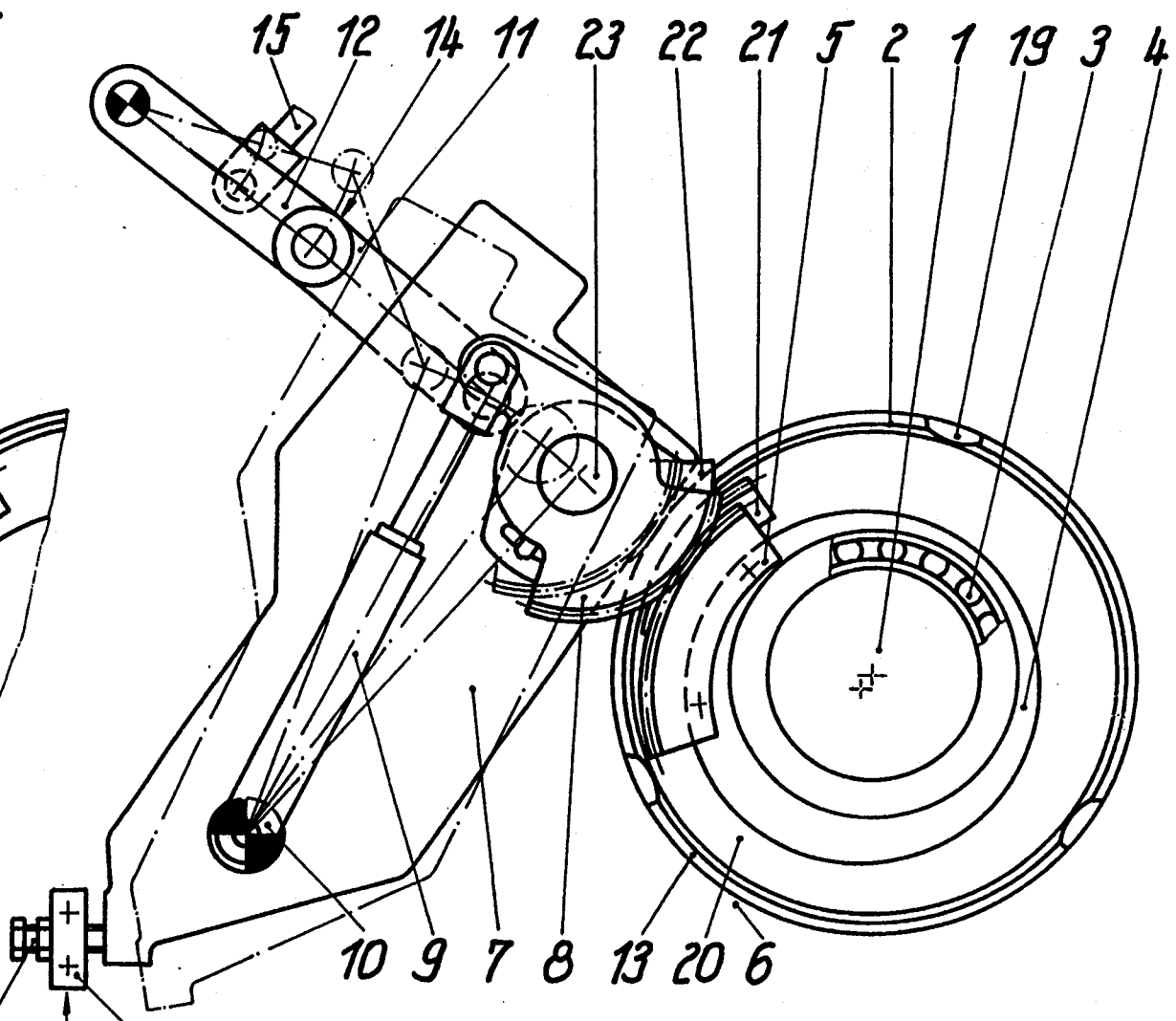
FIG. 1 shows the inventive apparatus in a side view.

As seen in the drawings, an eccentric bush 4, which brings about the impression adjustment of the impression cylinder by being twisted, is mounted over a ball bearing 3 on the axle journal 1 of an impression cylinder, which is equipped with a tube 2. At the front face of the eccentric bush 4, a first toothed quadrant 5 is fastened, which is engaged in the operating state by a second toothed quadrant 8, which is connected pivotably with a rocking lever 7 mounted on the supporting frame 6, and linked to a working cylinder 9. The cylinder 9 is operated by means of a pressure medium and is also mounted on the rocking lever 7.

With respect to avoiding a restoring moment on the rocking lever 7, a common mounting of the working cylinder 9 on the bearing bolt 10 of the rocking lever 7 is advantageous.

A toggle joint 14, which consists of two elements 11, 12, brings about the swiveling of the second toothed quadrant 8 out of its operating position into a position releasing the opening in the supporting frame 6 in the form of a wall borehole 13 for the exchange of tubes. The toggle joint 14 is mounted at one end into the supporting frame 6 and is linked to the rocking lever 7. To drive it, the toggle joint 14 is engaged by a working cylinder 15, which is operated by a pressure medium, pivotably mounted on the supporting frame 6 and shown only in outline in FIG. 1. The lift of the working cylinder 15 is limited by a stop 18 that consists of a body 17 fixed to the frame 6 and penetrated by an adjusting screw 16 via a tapped hole. The stop 18 adjusts the meshing of the second toothed quadrant 8 with the gearing of the eccentric bush 4 in the operating state and serves as a stop for the rocking lever 7.

Figure 2:
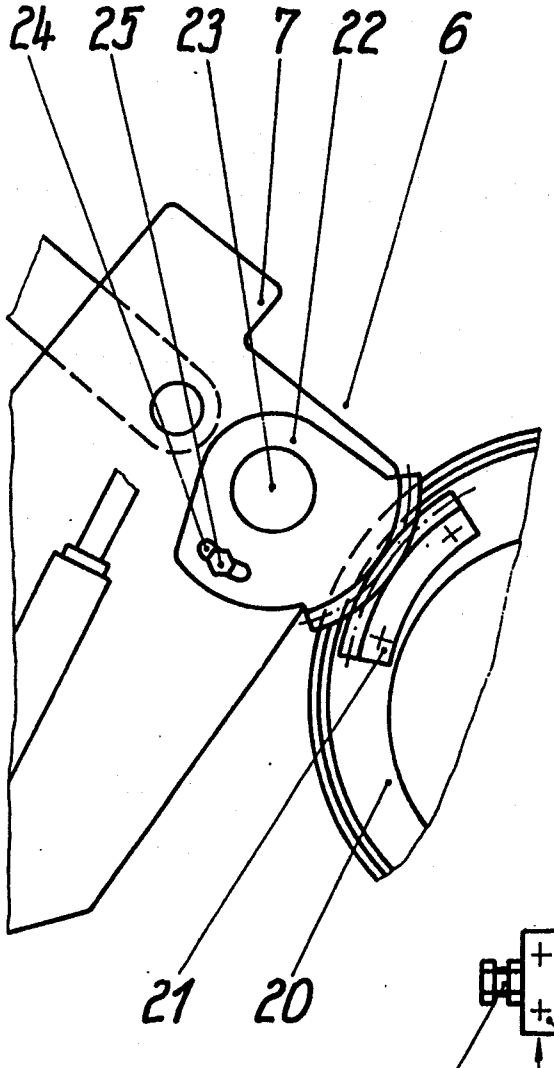
FIG. 2 shows the locking of the bearing bush of the impression cylinder as a partial view of FIG. 1, in which the covering toothed quadrant at the top for the eccentric bush is omitted.

So that a bearing bush 20, supported by three supporting bodies 19 which can be shifted out of the region of the wall borehole 13 for the exchange of tubes, is fixed to prevent twisting by the eccentric bush 4 during the impression adjustment of the impression cylinder, the bearing bush 20 also carries at an end face a third toothed quadrant 21, which is engaged in the operating state by a fourth toothed quadrant 22. The fourth quadrant 22 is fastened adjustably at the rocking lever 7 and can be swiveled with the latter out of the region of the wall borehole 13 for the exchange of tubes (FIG. 2). For its adjustment, the fourth toothed quadrant 22 is advantageously also mounted on the bearing bolt 23 for the second toothed quadrant 8, which serves to adjust the eccentric bush 4 and has been left out of FIG. 2. The fourth toothed quadrant 22 has a slot 24 extending in the swiveling direction, through which a clamping screw 25 passes and is carried in a tapped hole of the rocking lever 7.

The invention is not limited by the embodiments described above which are presented as examples only but can be modified in various ways within the scope of protection defined by the appended patent claims.

I claim:

1. An apparatus, in combination with a mounting, for adjusting a cylinder between a pressure-on position and a pressure-off position in a rotary printing press, the combination comprising: a supporting frame with an opening therein, the apparatus being mountable to the supporting frame by the mounting, the mounting comprising: an eccentric bush having a gearing, the mounting being arranged and adapted to be shiftable out of a region of the opening in the supporting frame so as to enable access to the cylinder, the apparatus comprising: a second toothed quadrant provided so as to engage the gearing of the eccentric bush, the eccentric bush being adapted to move into and out of an operating state in which the gearing engages the second toothed quadrant; a working cylinder, operable by a pressure medium, linked to the second toothed quadrant; a rocking lever mountable to the supporting frame, the second toothed quadrant and the working cylinder being pivotably connected to the rocking lever; and a two-membered driven toggle joint having a first end pivotably connected with the supporting frame and a second end connected with the rocking lever.

2. An apparatus and mounting as defined in claim 1, and further comprising an adjustable stop provided so as to limit movement of the rocking lever in a direction of the gearing of the eccentric bush.

3. An apparatus and mounting as defined in claim 2, wherein the stop includes a body fastened to the supporting frame and having a tapped hole therein, the stop further including an adjusting screw arranged to penetrate the tapped hole of the stop body.

4. An apparatus and mounting as defined in claim 1, wherein the rocking lever has a pivot point, the working cylinder being linked to the pivot point of the rocking lever.

5. An apparatus and mounting as defined in claim 1, and further comprising a further working cylinder, operable by a pressure medium, mounted to the supporting frame so as to pivotably engage the toggle joint.

6. An apparatus and mounting as defined in claim 1, and further comprising a first toothed quadrant fastened at the eccentric bush so as to engage the second toothed quadrant of the rocking lever.

7. An apparatus and mounting as defined in claim 1, and further comprising a bearing bush rotatably disposed on the eccentric bush, and a locking body connected with the rocking lever so as to be positively engageable with the bearing bush.

8. An apparatus and mounting as defined in claim 7, wherein the locking body is a fourth toothed quadrant which engages a third toothed quadrant fastened to the bearing bush.

9. An apparatus and mounting as defined in claim 7, wherein the rocking lever has a tapped hole therein and the second toothed quadrant has a bearing bolt, the fourth toothed quadrant being adjustably mounted on the bearing bolt of the second toothed quadrant and having a slot which extends in an adjusting direction, and further comprising a clamping screw provided so as to penetrate the slot and engage in the tapped hole in the rocking lever.

* * * * *